US005505459A

United States Patent [19]

Yiu

[11] Patent Number: 5,505,459

[45] Date of Patent: Apr. 9, 1996

[54] TARGET BOARD FOR DART GAME

[76] Inventor: Chih-Hao Yiu, 7F-1, No. 30, Lin Sen Road, Taichung, Taiwan

[21] Appl. No.: 514,963

[22] Filed: Aug. 14, 1995

[51] Int. Cl.[6] ..... A63B 3/00

[52] U.S. Cl. ..... 273/408

[58] Field of Search ..... 273/408, 403, 273/404

[56] References Cited

U.S. PATENT DOCUMENTS 271,647 2/1883 Medart ..... 273/403 X
2,818,259 12/1957 Arenson ..... 273/408
3,900,778 8/1975 Bruner ..... 273/403
4,057,251 11/1977 Jones et al. ..... 273/408 X

*Primary Examiner*—William H. Grieb
*Attorney, Agent, or Firm*—Charles E. Baxley

[57] ABSTRACT

A dart board includes a scoring area having a number of triangular holes formed by a number of triangular peripheral walls. The triangular peripheral walls each includes three tapered surfaces formed in the inner peripheral portion so as to form a wider front portion and so as to form a narrower rear portion such that the holes each includes a widely opened front portion for effectively receiving and for guiding a dart into the holes. The narrower rear portions of the holes each includes a size smaller than that of the dart for stably retaining the dart in place.

2 Claims, 6 Drawing Sheets

TARGET BOARD FOR DART GAME

BACKGROUND OF THE INVENTION

1. Field of the Invention

The present invention relates to a target board, and more particularly to a target board for a dart game.

2. Description of the Prior Art

Various kinds of dart games have been developed. One typical dart game is shown in FIGS. 5 and 6 and comprises a dart board 90 including a number of to concentric annular ribs 91 and a number of angularly spaced radial ribs 92 intersected with each other so as to form a number of spaced scoring areas 93 of different score values for receiving a number of target boards 99 therein. The target boards 99 each includes a number of holes 94 formed therein. The holes 94 each includes an opening portion having a tapered surface or a frustum-shaped surface 95 for receiving and for guiding the darts into the holes 94. However, the opening portions 95 of the holes 94 are so small that the darts may not be smoothly and effectively received and guided into the holes 94.

The present invention has arisen to mitigate and/or obviate the afore-described disadvantages of the conventional target boards for dart games.

SUMMARY OF THE INVENTION

The primary objective of the present invention is to provide a target board for a dart game in which the target board includes a number of widely opened holes therein for effectively receiving the darts.

In accordance with one aspect of the invention, there is provided a dart board comprising a scoring area including a number of triangular holes formed therein and defined by a number of triangular peripheral walls respectively, the triangular peripheral walls each including an inner peripheral surface having three tapered surfaces formed therein so as to form a wider front portion and so as to form a narrower rear portion such that the holes each includes a widely opened front portion for receiving and for guiding a dart into the holes, the narrower rear portions of the holes each including a size smaller than that of the dart for retaining the dart in place.

The peripheral portion of the dart board surrounding the scoring area may also include a number of triangular holes formed therein. The holes each also includes a widely opened front portion for receiving and for guiding a dart into the holes, the narrower rear portions of the holes each includes a size smaller than that of the dart for retaining the dart in place.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
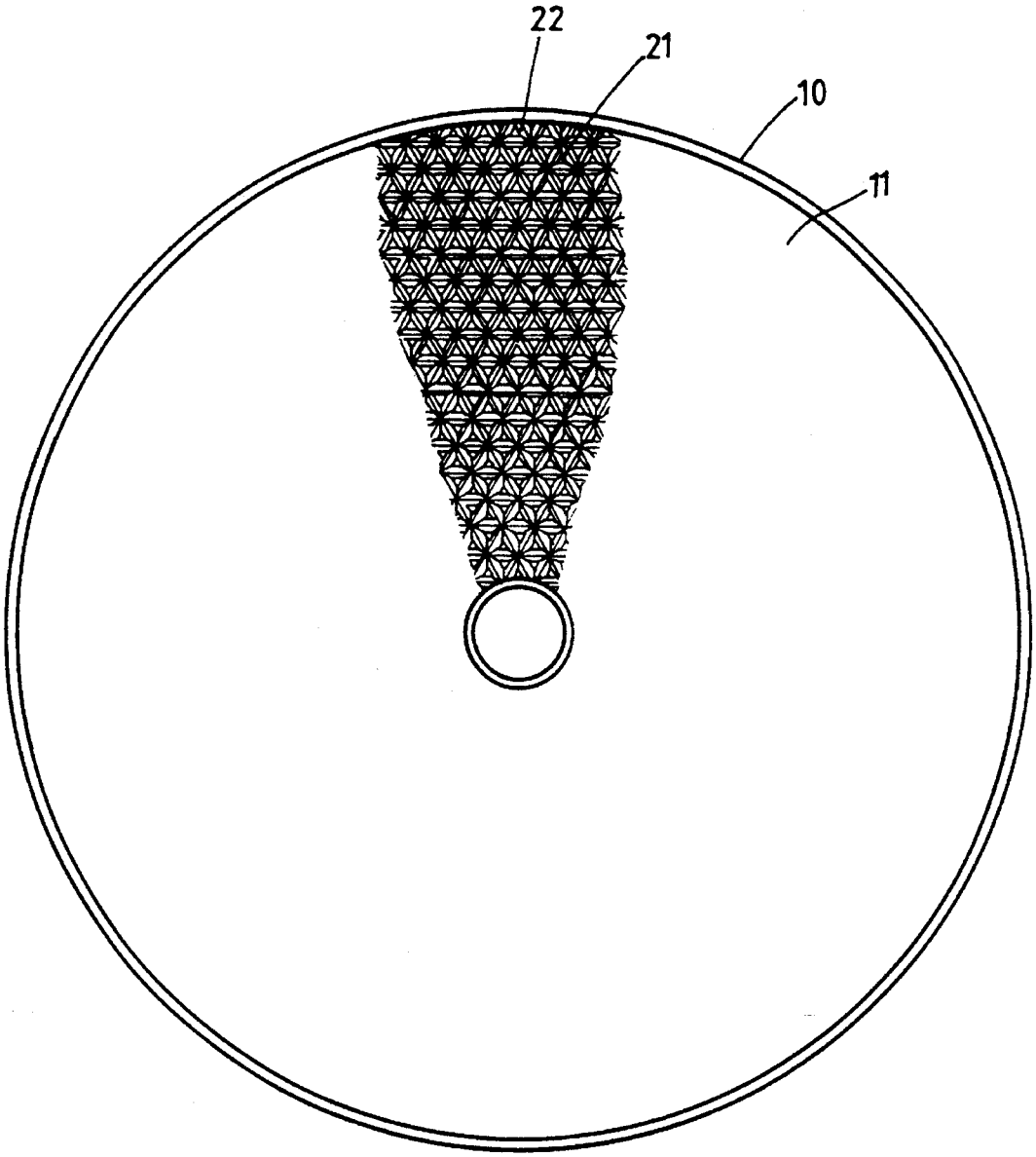
FIG. 1 is a partial front view of a dart board in accordance with the present.
Figure 2:
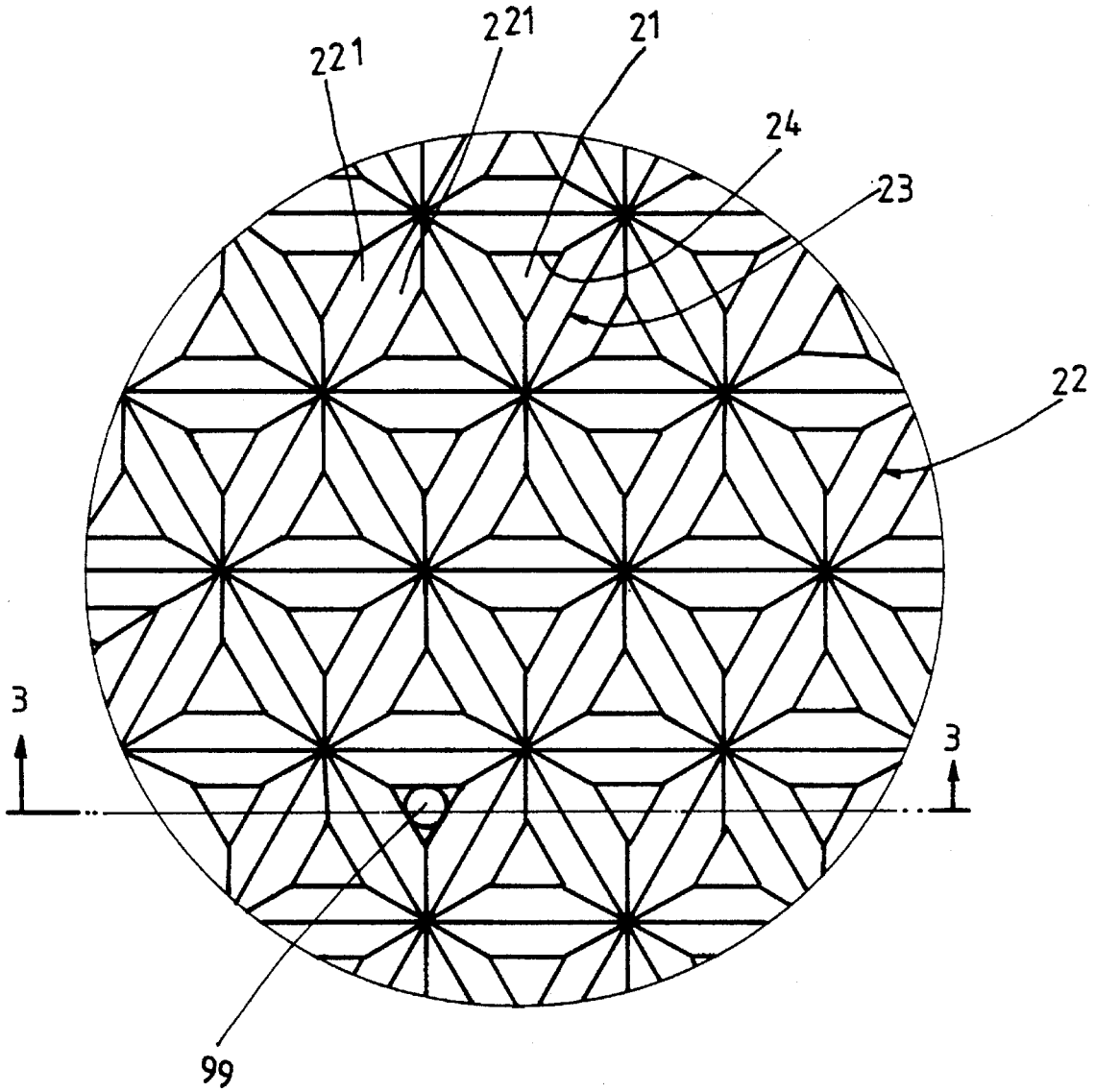
FIG. 2 is an enlarged partial front view of the target board.
Figure 3:
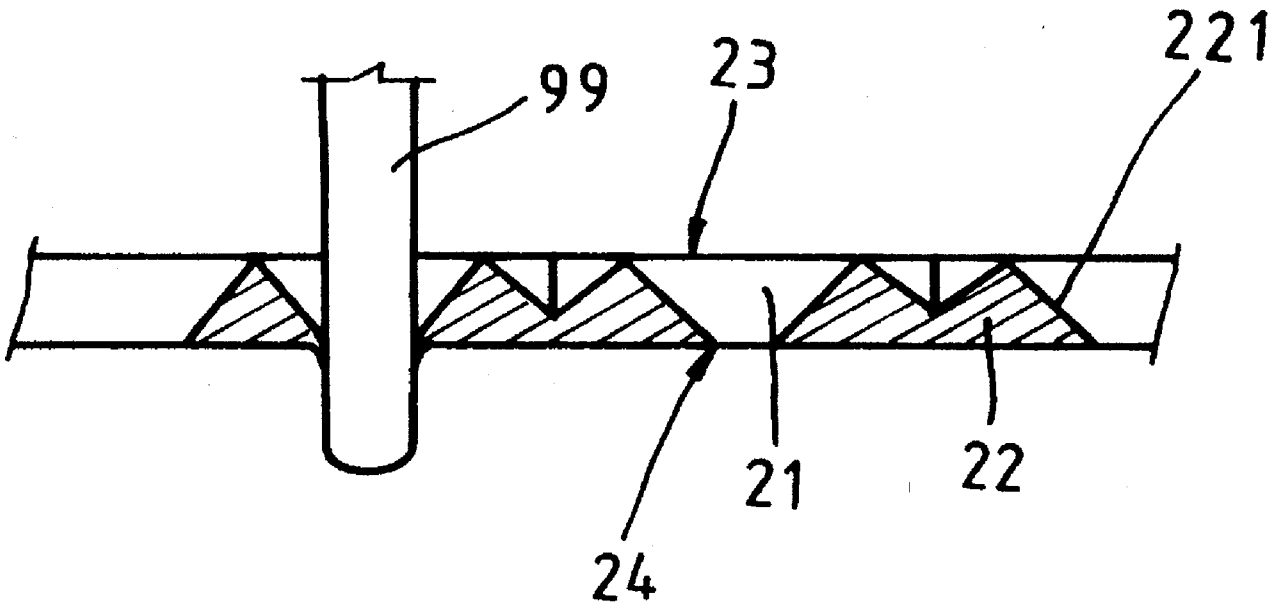
FIG. 3 is a cross sectional view taken along lines 3—3 of FIG. 2.

Referring to FIGS. 1 to 3, illustrated is a dart board 10 in accordance with the present invention. The dart board 10 comprises a scoring area 11 including a number of holes 21 formed therein and each defined by a triangular peripheral wall 22. The triangular peripheral wall 22 includes an inner peripheral surface having three tapered surfaces 221 formed therein so as to form a wider front portion 23 and a narrower rear portion 24 such that the holes 21 each includes a widely opening portion for receiving and for guiding the tips 99 of the darts into the holes 21. The tips 99 of the darts include a size no less than that of the holes 21 such that the tips 99 may engage with the peripheral portion of the narrower rear portion 24 of the peripheral wall 22 and may be stably retained within the holes 21.

Figure 4:
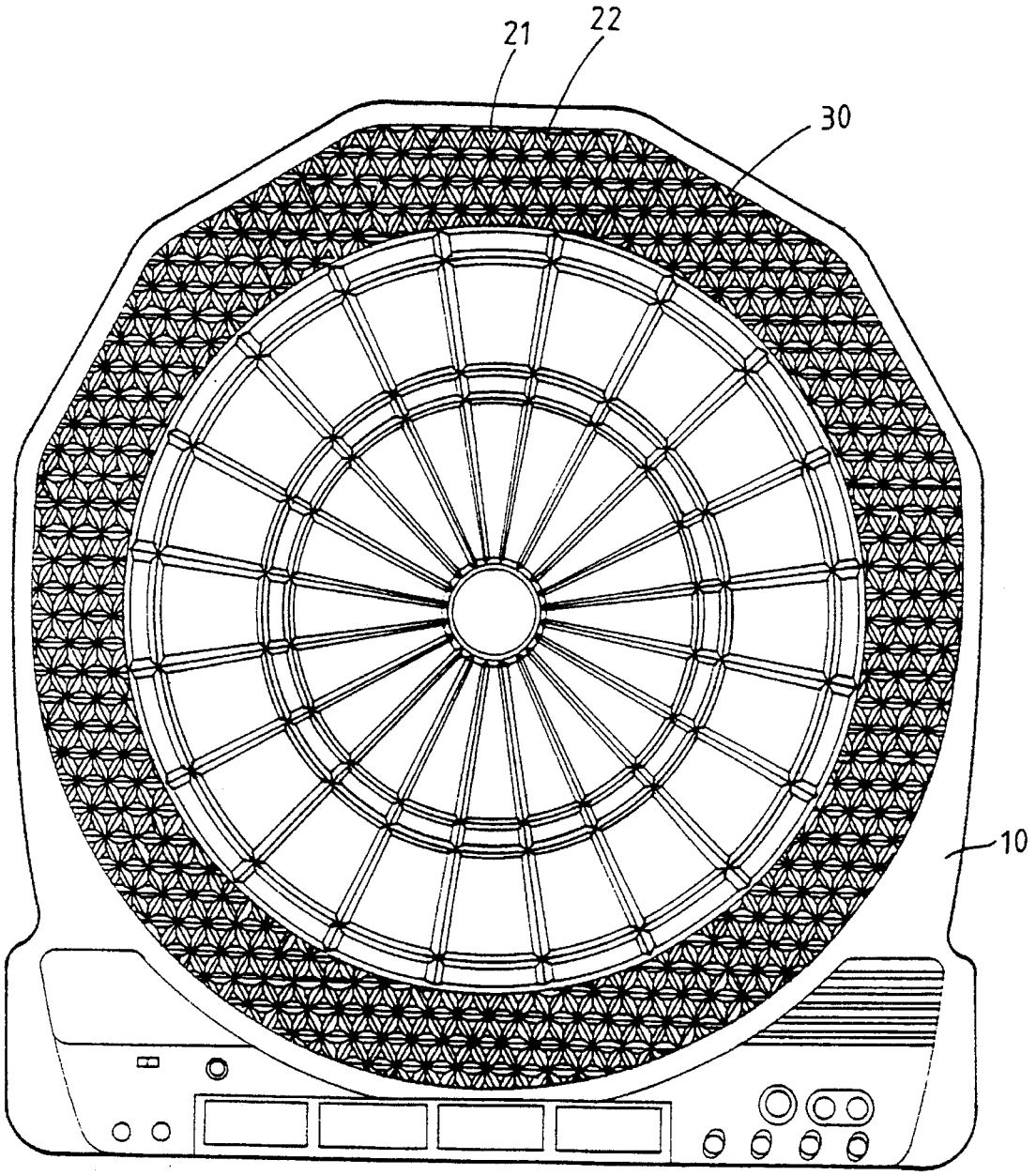
FIG. 4 is a front view of the dart board.
Figure 5:
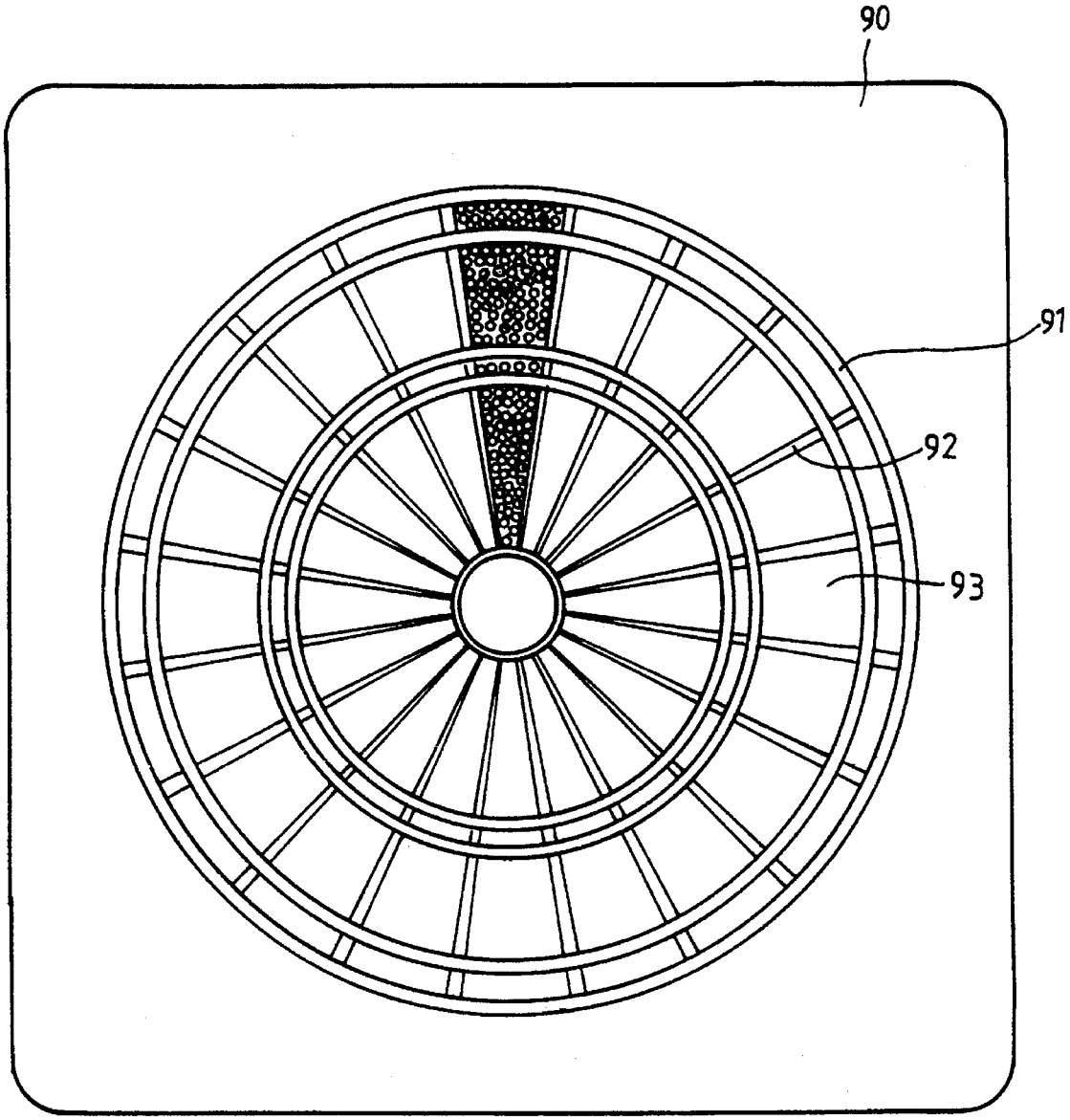
FIG.5 PRIOR ART
FIG. 5 is a front view of a typical target game.
Figure 6:
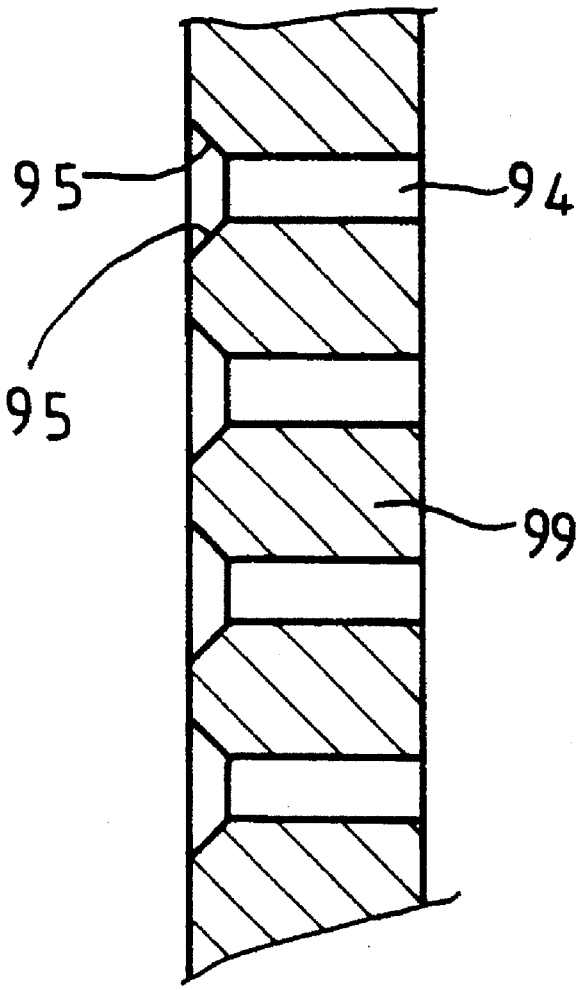
FIG.6 PRIOR ART
FIG. 6 is a partial cross sectional view of a typical target board.

Referring next to FIG. 4, the target board 10 includes a peripheral portion 30 surrounding the target area 11. The peripheral portion 30 also includes a number of triangular holes 21 formed therein and defined by a number of triangular peripheral walls 22. The triangular holes 21 also include a widely opening portion 23 for effectively receiving and guiding the darts 99 into the holes.

It is to be noted that the darts may also be easily and effectively engaged in the holes 21 when the darts 99 are shot at the dart board 10 with a slope.

Accordingly, the target board includes a number of triangular holes each having a widely opening portion for effectively receiving and guiding the darts into the holes.

Although this invention has been described with a certain degree of particularity, it is to be understood that, the present disclosure has been made by way of example only and that numerous changes in the detailed construction and the combination and arrangement of parts may be resorted to without departing from the spirit and scope of the invention as hereinafter claimed.

I claim:

1. A dart board comprising:

a scoring area including a plurality of triangular holes formed therein and defined by a plurality of triangular peripheral walls respectively, said triangular peripheral walls each including an inner peripheral surface having three tapered surfaces formed therein so as to form a wider front portion and so as to form a narrower rear portion such that said holes each includes a widely opened front portion for receiving and for guiding a dart into said holes, said narrower rear portions of said holes each including a size smaller than that of the dart for retaining said dart in place.

2. A dart board comprising:

a scoring area and a peripheral portion surrounding said scoring area, said peripheral portion of said dart board including a plurality of triangular holes formed therein and defined by a plurality of triangular peripheral walls respectively, said triangular peripheral walls each including an inner peripheral surface having three tapered surfaces formed therein so as to form a wider front portion and so as to form a narrower rear portion such that said holes each includes a widely opened front portion for receiving and for guiding a dart into said holes, said narrower rear portions of said holes each including a size smaller than that of the dart for retaining said dart in place.

* * * * *